United States Patent [19]

Sensabaugh, Jr. et al.

[11] Patent Number: 4,528,993

[45] Date of Patent: Jul. 16, 1985

[54] PROCESS FOR PRODUCING MOIST SNUFF

[75] Inventors: Andrew J. Sensabaugh, Jr.; Ronald L. Parks, both of Winston-Salem; Arvol C. Marsh, Jr., Rural Hall, all of N.C.

[73] Assignee: R. J. Reynolds Tobacco Company, Winston-Salem, N.C.

[21] Appl. No.: 538,202

[22] Filed: Oct. 3, 1983

Related U.S. Application Data

[63] Continuation-in-part of Ser. No. 410,091, Aug. 20, 1982, abandoned.

[51] Int. Cl.[3] ..... A24B 15/20; A24B 15/22; A24B 15/28

[52] U.S. Cl. ..... 131/290; 131/309; 131/310

[58] Field of Search ..... 131/302, 290, 308, 309, 131/310, 300

[56] References Cited

U.S. PATENT DOCUMENTS 3,327,716 6/1967 Kohan ..... 131/290

*Primary Examiner*—V. Millin

*Attorney, Agent, or Firm*—III, Joseph E. Root

[57] ABSTRACT

A method in which moist snuff is produced, differing radically from the prior art. The tobacco is hogshead-aged for only about two years. Instead of producing snuff taste characteristics through fermentation, the tobacco is cased and chemical reactions, including Maillard reactions, are induced to produce snuff flavor precursors chemically.

10 Claims, 1 Drawing Figure

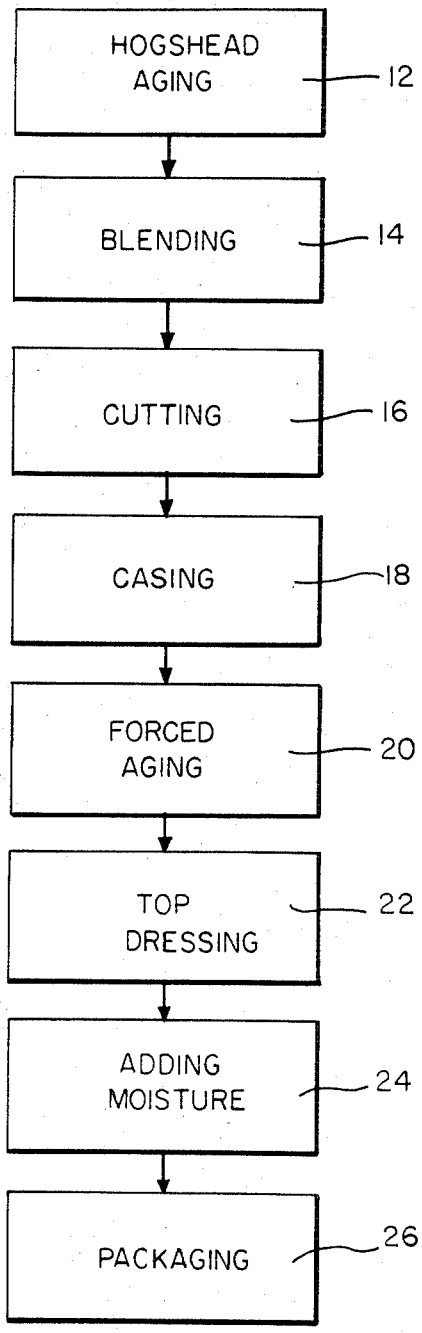
HOGSHEAD AGING
12
BLENDING
14
CUTTING
16
CASING
18
FORCED AGING
20
TOP DRESSING
22
ADDING MOISTURE
24
PACKAGING
26

PROCESS FOR PRODUCING MOIST SNUFF

BACKGROUND OF THE INVENTION

This application is a continuation-in-part of application Ser. No. 410,091 filed Aug. 20, 1982 now abandoned.

This invention relates to a novel tobacco manufacturing process, and more particularly to a process for producing moist snuff.

Snuff is one of the oldest tobacco products known. Two types exist, dry snuff and moist (or wet) snuff. The former is produced as a dry powder, while the latter is finely cut rather than ground and has a high moisture level. The present invention concerns moist snuff, and further discussion will be limited to that product.

Snuff manufacture differs radically from the production of more widely used tobacco products, such as cut filler for cigarettes or smoking tobacco. As an initial point, it should be recognized that snuff is composed primarily of tobaccos different from those used in other tobacco products. These tobaccos—often referred to as "snuff-type" tobaccos—are varieties such as Dark Fired, Green River, and One-Sucker tobaccos, primarily from Tennessee and Kentucky. These tobaccos can be characterized chemically by a high level of nitrogenous constituents, particularly nicotine. Physically, these tobaccos are heavy-bodied, having long, wide leaves. Use of these tobacco types is dictated by considerations of flavor and the ability to withstand processing; other tobacco types tend to degrade physically when subjected to snuff processing. A modern snuff mixture might also contain a significant percentage of other tobacco materials, such as rolled stems. A traditional snuff blend, for example, could contain approximately 70% Dark Fired tobacco, 10% each of One-Sucker and Green River, and 10% of a more common tobacco variety, such as Burley.

Traditional snuff processing begins when the tobacco is packed for aging in the hogsheads. The tobacco is packed at a relatively high level of moisture content, in the range of 18–22%. This contrasts to the practice of packing tobacco at moisture levels around 12% for other tobacco processes. Then, the tobacco is stored for a period of three to five years, instead of the average of two years's storage given other tobacco types. This lengthened storage results in greater fermentation of the snuff-type tobaccos. Thus, snuff tobaccos must be processed differently from other tobaccos in terms of the packing itself and the aging process.

Aged tobacco is removed from the hogshead, and sufficient water is added (if needed) to bring the moisture level into the 20–25% range. The wet tobacco is then stacked, and in short order a bacterial fermentation process begins, highly analogous to the familiar composting process. The bacteria produce enzymes which reduce the natural sugars present in the tobacco to produce the flavor precursors unique to set snuff. The process is not allowed to proceed uncontrolled, however. The temperature of the tobacco mass is monitored, and when the internal heat rises into the range 135°–140° F. (57°–60° C.), the tobacco pile is "turned out"—that is, agitated and tumbled, to interrupt the bacterial growth. This action lowers the temperature of the tobacco mass and avoids killing the bacteria, which are vulnerable to high temperature levels. Also, the fermentation process is allowed to proceed, but at a relatively slow rate. Thus, the tobacco is not degraded into a compost-like product, but is converted to snuff. Typically, the fermentation process requires two to three months, with the mass being turned several times during that period.

Other tobacco processes do not make use of such fermentation techniques. For example, both cigarette tobaccos and pipe tobaccos are processed by applying casing materials—flavorants, such as sugars, cocoa, licorice, and other materials known to the art—at an initial stage, and then are cut to selected sizes to suit the end use.

The primary difference between these processes in the taste and flavor to be delivered by the end product. In products such as cigarettes and pipe tobacco, the objective is a "natural tobacco" flavor and taste. In snuff, the objective is the unique "snuff-like" taste that results from the fermentation process.

A significant drawback of the traditional snuff process is the time required during the cycle. Even with modern techniques, 60 to 90 days of processing are required between the time tobacco is unpacked from the hogshead and final packaging. In contrast, cigarette tobacco requires a period of only a few days between unpacking tobacco and shipping finished product.

Final processing of wet snuff is likewise unique to that product. First, the product is cut considerably finer than other tobacco products—typically, in the range 120–140 cuts per inch. Then, additives unique to wet snuff are added immediately after cutting. Salt and ash are traditional ingredients not used in other tobacco processes that may be used as preservatives, to retard mold, or to control pH or further fermentation. Additionally, wet snuff typically includes a strong flavoring ingredient such as wintergreen, attar of rose, or other ingredients to give the product a distinctive flavor in addition to the "snuff" taste. Finally, moisture is added in final processing to bring the moisture level of the final product into the range 45–55%, in contrast to the 12–15% seen in cigarette processes.

As a result, snuff is a difficult product to produce. First, snuff tobaccos have to be specially packed and separated from other tobaccos during storage. Second, the storing period is significantly longer than that for other tobacco products, requiring inordinately high raw material inventories. Third, the processing itself proceeds in a manner so different from other tobacco processes that entirely new skills and technology must be acquired. Finally, the processing cycle is so lengthy that significant quantities of material are required for in-process inventory. Clearly, improved and streamlined snuff processing techniques would bring significant benefit to the tobacco industry.

SUMMARY OF THE INVENTION

The broad object of the present invention is an improved process for producing wet snuff.

A further object of the present invention is a snuff manufacturing process which permits the use of tobaccos aged in a manner similar to that employed for other tobacco processes.

Another object to this invention is to reduce significantly the processing cycle time for moist snuff.

Yet another object of the present invention is to produce snuff through a process more amenable to process control techniques than are traditional fermentation processes.

These and other objects are accomplished in the present invention through a radical departure from traditional snuff processing techniques. Rather than relying upon a fermentation process to reduce sugars and produce snuff flavor precursors, the present invention employs a chemical reaction process. Tobaccos are stored in hogsheads for about two years, similar to the storage period seen in other tobacco processes. Then, the tobacco is cut into particles. After cutting, casing materials, such as sugars, cocoa, etc., are applied to the tobacco. At this point, the tobacco enters a forced aging step, which chemically simulates the results of traditional fermentation. The tobacco is raised to a temperature of about 160°-190° F. (71°-88° C.), at which point a series of chemical reactions, including Maillard reactions, occur. These reactions are exothermic, so that the tobacco can be held at elevated temperature levels without further addition of heat. The reactions are allowed to proceed for about 24-48 hours, at which time the sugars found in the casing materials and the natural tobacco sugars are reduced, producing snuff flavor precursors. After the forced aging step, flavorants are added, and the product is packed.

BRIEF DESCRIPTION OF THE DRAWING

FIG. 1 is a schematic representation of the present invention.

DETAILED DESCRIPTION OF A PREFERRED EMBODIMENT

The present invention produces moist snuff in a manner radically different from the traditional process. Initially the hogshead aging step 12 is reduced to a maximum of two to three years in hogsheads, at a moisture level in the range 12-14%. Thus, hogshead aging more closely resembles the techniques of the cigarette-making art than it does any known snuff processes.

The tobacco is then blended 14 using techniques and apparatus known in the art. As a part of this step, the tobacco moisture level is adjusted to about 12-18% in apparatus such as reordering drums, normally employing steam conditioning. The exact blend may vary according to the taste characteristics desired, but snuff-type tobaccos should constitute the major portion of the mixture. Applicant's preferred embodiment consists of 5-25% Dark Fired tobacco, 10-30% Green River, 30-50% One-Sucker, and up to 40% other tobacco materials.

The blended mixture then moves to cutting 20 which employs either blade cutters or hammer mills, of which many types are well known in the art. Cutting parameters can be varied depending upon the desired degree of fineness in the finished product, within a normal range of 20-120 cuts per inch. Applicant prefers a double cut, using two cutters rather than the cutter/hammer mill combination often used in the art. The first cutter is set at about 32 cuts per inch, and the second at about 90 cuts per inch. It has been found that cutting before casing improves the casing material penetration, leading to enhanced taste characteristics.

Next, the cut mixture enters the casing step 16. Here, using apparatus known to the art, "casing materials" such as licorice, flavorants, and sugars are applied to the tobacco mixture. Casing is a process step associated with cigarette, chewing tobacco, and smoking tobacco production almost exclusively. In these three arts, casing materials affect the delivery of nicotine, to produce "milder" products. Those having skill in those arts will be able to formulate specific blends of casing materials to practice the present invention, but it should be emphasized that the moist snuff art has never used a casing step as described herein. Casing normally is carried out at a temperature over 140° F. (60° C.), preferably in the range 140°-190° F. (60°-88° C.) and more preferably at about 190° F. (88° C.).

The cased mixture then enters a forced aging stage 18. Forced aging simulates the result of traditional fermentation by inducing chemical reactions in the tobacco mixture. Some of these reactions, known as Maillard reactions, produce browning reactions in both the natural tobacco sugars and the sugars present in the casing material. These reactions result in darkening tobacco and producing snuff flavor precursors. Other chemical reactions, of unknown types, are also occurring. It has been found that inducing such reactions in uncased tobacco fails to produce the desired taste characteristics.

Forced aging is induced by placing the tobacco mixture (which emerges from the previous casing step at a temperature between about 160° and 200° F. (71°-93° C.), preferably 190° F. (88° C.)) into containers, where it remains between about 24 and 48 hours. The Maillard and other reactions are induced by maintaining the tobacco at this elevated temperature during the holding period. Temperature can be maintained by initially applying external heat to the container holding area, as with steam, or simply by maintaining the containers within an insulated area. These reactions are exothermic, and the liberated heat assists in maintaining the proper temperature. With either method, the tobacco temperature rises to about 200° F. (93° C.). The product that emerges from the 24-48 hour process closely simulates that produced through traditional fermentation, but it does so in one to two days rather than two to three months. At this stage, the product has a moisture content between 25 and 45%.

It is preferred to perform the cutting step before casing, in order to insure maximum coating and penetration by casing materials before forced-aging. Cutting may be done after casing or after forced aging, but that method produces less acceptable product.

Then, applicant adds top dressing 22 to the forced-aged mixture. Here, pH may be adjusted by addition of ammonium carbonate, sodium bicarbonate, or other additives. Salt and flavorants such as wintergreen or mint also are added to produce the flavor desired.

Next, the moisture level of the moist snuff is raised 24 to the range 45-55%, to correspond to the consumer's expectation for a moist snuff product. This step is accomplished by apparatus such as reordering drums, known in the art. Careful control must be exercised during this step, as consumers have exact expectations concerning the proper moisture level for a moist snuff.

The product, still having a moisture content between about 45 and 55%, preferably 52%, is then packaged 26 and shipped to consumers, using techniques known to the art.

It should be understood that variations in the method of production and in the product itself will be obvious to those having skill in the art. For example, the proportions or types of snuff-type tobaccos may be altered, or the time/temperature relationships could be varied to produce desired flavors. Such variations are included within the scope of the present invention.

We claim:

1. A method for producing moist snuff from tobacco, comprising the steps of:

hogshead-aging tobaccos for a period of about two years;

blending the tobaccos to produce a snuff mixture;

cutting said blended mixture into particles;

casing said cut mixture by applying casing materials to said cut mixture;

forced-aging said cased mixture by inducing chemical reactions in said cased mixture;

top-dressing said forced-aged mixture;

adjusting the moisture level of said top-dressed mixture to a range between about 45–55%; and packaging said adjusted mixture.

2. The method of claim 1, wherein said forced aging step includes:

raising the temperature of said cased mixture to an elevated level about 140° F. (60° C.); and maintaining said elevated level for a time period between about 24–48 hours.

3. The method of claim 2, wherein said elevated level is in the range 160°–200° F. (71°–93° C.).

4. The method of claim 2, wherein said elevated level is about 190° F. (88° C.).

5. The method of claim 2, wherein said maintaining step includes:

insulating said cased mixture for preventing heat loss; and reacting said casing mixture exothermically.

6. The method of claim 2, wherein said maintaining step includes:

monitoring the temperature of said cased mixture; and adding heat when said temperature falls below said elevated level.

7. The method of claim 1, wherein said casing materials include licorice.

8. The method of claim 1, wherein said casing materials include sugars.

9. The method of claim 1, wherein said casing materials include cocoa.

10. The method of claim 1, wherein said casing step occurs after said forced-aging step.

* * * * *